US007673815B2

(12) United States Patent
Schroeder et al.

(10) Patent No.: US 7,673,815 B2
(45) Date of Patent: Mar. 9, 2010

(54) LINE STRIPER

(75) Inventors: James C. Schroeder, Ramsey, MN (US); Eric J. Finstad, Rogers, MN (US); Neil A. Taylor, Elk River, MN (US); Robert J. Gundersen, Otsego, MN (US)

(73) Assignee: Graco Minnesota Inc., Minneapolis, MN (US)

( * ) Notice: Subject to any disclaimer, the term of this patent is extended or adjusted under 35 U.S.C. 154(b) by 163 days.

(21) Appl. No.: 11/721,455

(22) PCT Filed: Dec. 21, 2005

(86) PCT No.: PCT/US2005/046336

§ 371 (c)(1),
(2), (4) Date: Jun. 12, 2007

(87) PCT Pub. No.: WO2006/069139

PCT Pub. Date: Jun. 29, 2006

(65) Prior Publication Data

US 2008/0099579 A1 May 1, 2008

Related U.S. Application Data

(60) Provisional application No. 60/637,696, filed on Dec. 21, 2004.

(51) Int. Cl.
*E01C 23/16* (2006.01)
*E01C 23/22* (2006.01)
*B05B 9/04* (2006.01)
*B05B 1/28* (2006.01)
*E01H 3/02* (2006.01)

(52) U.S. Cl. ..... 239/332; 239/146; 239/150; 239/172; 239/525; 239/DIG. 14; 404/93; 404/94

(58) Field of Classification Search ..... 239/146, 239/147, 150, 172, 332, 525–528, 578, DIG. 14; 404/83, 93, 94; 118/301, 305; 417/34, 234
See application file for complete search history.

(56) References Cited

U.S. PATENT DOCUMENTS 5,169,068 A * 12/1992 Bertolini ..... 239/154
5,421,520 A * 6/1995 Simonette et al. ..... 239/525
6,648,603 B2 * 11/2003 Dexter et al. ..... 417/34

OTHER PUBLICATIONS

"Line Striping Systems," Graco Inc., Minneapolis, Minnesota, copyright 2002, Form No. 300588B, pp. 1-12.

* cited by examiner

*Primary Examiner*—Darren W Gorman
(74) *Attorney, Agent, or Firm*—Douglas B. Farrow

(57) ABSTRACT

A line striper (10) is provided with a relatively small engine (16) operating a reciprocating piston pump (20) and having a centrifugal clutch (18) which actuates when a predetermined engine speed has been reached. A pressure bypass device (22) which opens at either a fixed or adjustable pressure is provided to bleed off excess pressure and maintain a consistent spraying pressure. A double acting trigger (30) is provided for the operator to actuate the spray gun (40) and raise the engine speed simultaneously.

2 Claims, 2 Drawing Sheets

LINE STRIPER

This application claims the benefit of U.S. application Ser. No. 60/637,696, filed on Dec. 21, 2004.

TECHNICAL FIELD

Background Art

Self-powered line stripers such as Graco's LINELAZER are well known. Such stripers typically have a gas engine also having an electrical output sufficient to operate an electrical clutch.

DISCLOSURE OF THE INVENTION

It is therefore an object of this invention to provide a much lighter and lower cost striper by utilizing an engine without an electrical output. Towards this end, a relatively small engine is provided with a centrifugal clutch which actuates when a predetermined RPM level had been reached. A pressure bypass device (which opens at either a fixed or adjustable pressure is provided to bleed off excess pressure and maintain a consistent spraying pressure. A double acting trigger is provided for the operator to actuate the spray gun and raise the engine RPM simultaneously These and other objects and advantages of the invention will appear more fully from the following description made in conjunction with the accompanying drawings wherein like reference characters refer to the same or similar parts throughout the several views.

BEST MODE FOR CARRYING OUT THE INVENTION

Figure 1:
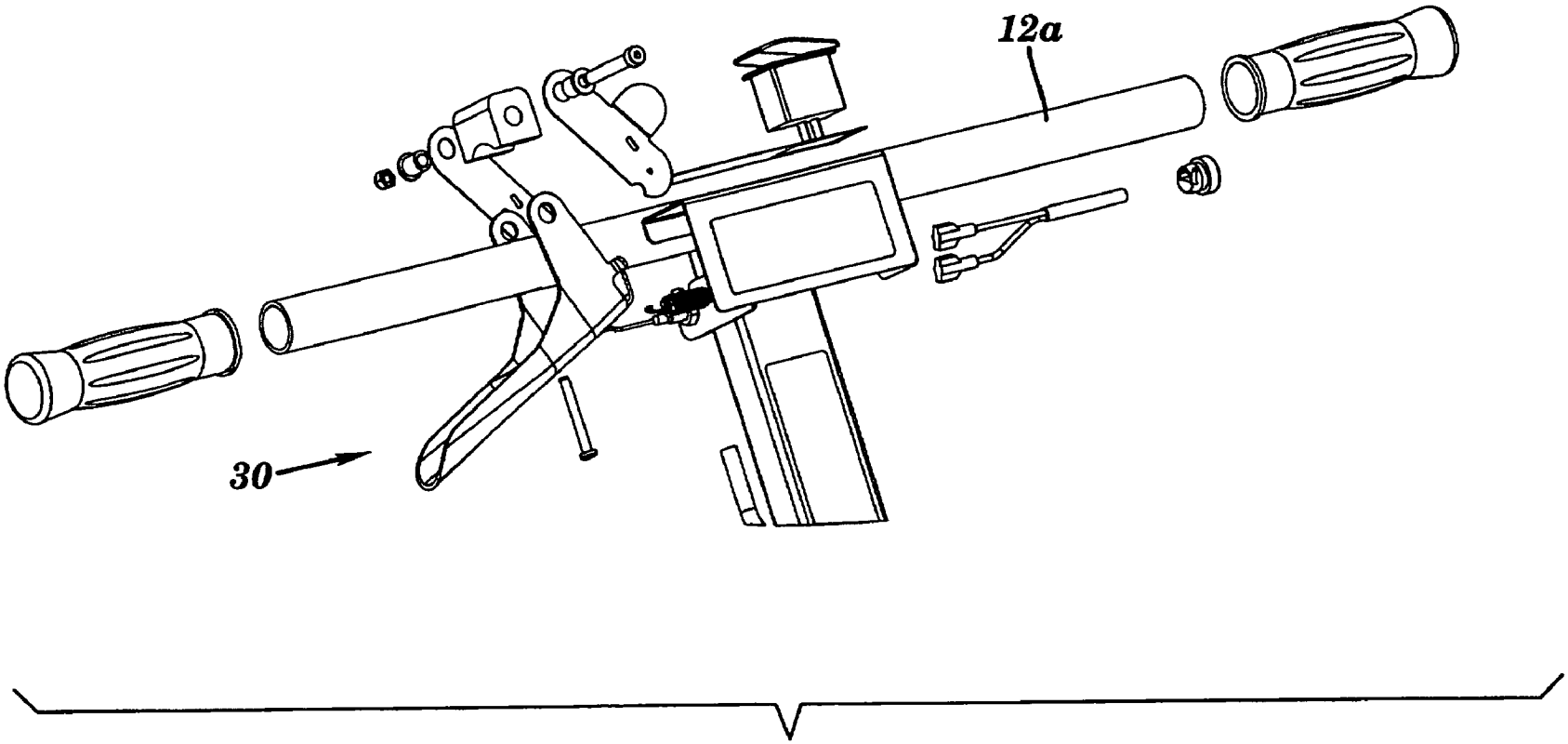
FIG. 1 is a perspective view of the striper of the instant invention.
Figure 2:
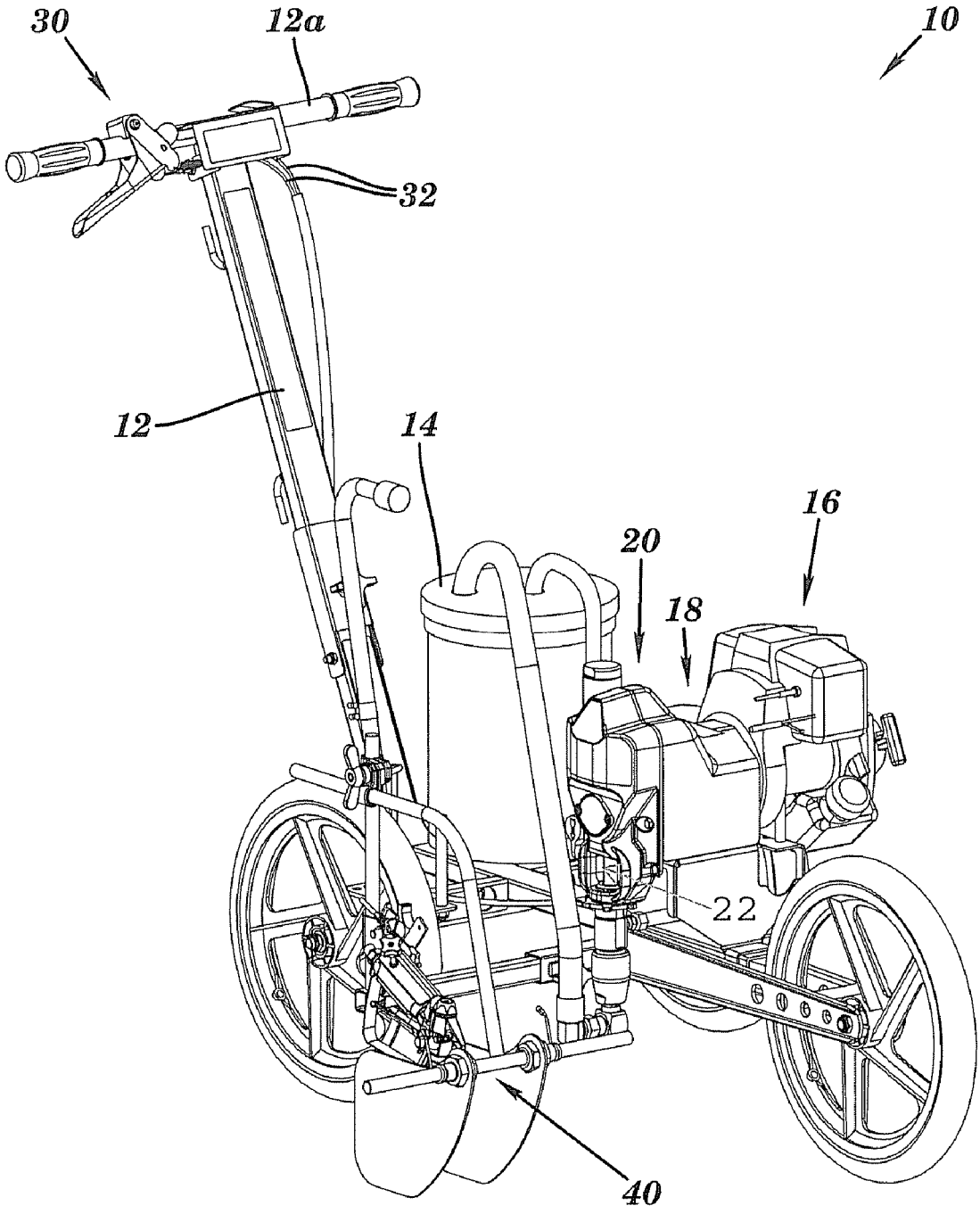
FIG. 2 is an exploded view of the trigger assembly.

The striper of the instant invention, generally designated 10 is comprised of a cart 12 having located thereon a container 14 for paint or other material to be applied, a gasoline engine (or equivalent portable power source) 16, a pump 20 (preferably of the reciprocating piston type) and a centrifugal clutch 18 connecting engine 16 and pump 20. Clutch 18 is of the well known type that engages when a predetermined RPM level had been reached.

Attached to the outlet of pump 20 is a bypass valve 22 which, when a predetermined spraying pressure is exceeded, directs the pump output back to the container 14. This bypass 22 operates when the spray gun 40 is closed and not spraying or anytime the pump output exceeds that being used for spraying.

A trigger 30 is provided on the handlebar 12*a* of cart 12 which operates twin cables 32. A first cable 32 is connected to the throttle of engine 16. The second cable 32 is connected to spray gun 40 which is a conventional airless spray gun. Actuation of trigger 30 thus raises the engine 16 RPM, engages the clutch 18 and raises the pressure in pump 20 and well as opening spray gun 40 to initiate spraying. In the preferred embodiment, there is a slight lead/lag built into the cable arrangement (the spray gun cable 32 may have some slack in it) whereby the engine speed is brought up slightly before spraying is started. The trigger 30 is also constructed so as to allow is to be locked "on" so that that spray gun may be used as a hand spray gun by the operator (the spray gun cable 32 is detached from the gun 40) and the engine speed raised to a level suitable for spraying.

It is contemplated that various changes and modifications may be made to the line striper without departing from the spirit and scope of the invention as defined by the following claims.

The invention claimed is:

1. A line striper for applying materials, said striper comprising:

a wheeled cart;

an engine having a non-zero idle speed;

a pump having an outlet;

a centrifugal clutch connecting said engine and said pump, said clutch engaging at a predetermined engine speed;

a spray gun fixedly attached to said cart and directed to paint lines on the surface on which said cart is located; and a trigger attached to said engine, said cart and said spray gun so that actuation of said trigger raises the speed of said engine above said idle speed and opens said spray gun wherein said trigger raises said engine speed before opening said spray gun.

2. The line striper of claim 1 further comprising a bypass valve connected to said pump outlet, said bypass valve opening upon attainment of a predetermined pressure.

* * * * *